United States Patent [19]

LeBlanc

[11] Patent Number: 4,579,036

[45] Date of Patent: Apr. 1, 1986

[54] AZIMUTH DRIVE ASSEMBLY

[75] Inventor: James C. LeBlanc, Mt. Clemens, Mich.

[73] Assignee: General Motors Corporation, Detroit, Mich.

[21] Appl. No.: 652,934

[22] Filed: Sep. 21, 1984

Related U.S. Application Data

[63] Continuation of Ser. No. 437,852, Oct. 29, 1982, abandoned.

[51] Int. Cl.[4] ..... F41F 21/08

[52] U.S. Cl. ..... 89/41.12; 74/625

[58] Field of Search ..... 89/36.13, 41.01, 41.02, 89/41.12; 74/625

[56] References Cited

U.S. PATENT DOCUMENTS

| | | | |
|---|---|---|---|
| 2,388,010 | 10/1945 | Pohl | 89/41.12 |
| 2,404,127 | 7/1946 | Ernest | 89/41.12 |
| 2,453,173 | 11/1948 | Wright et al. | 89/41.12 |
| 2,723,596 | 11/1955 | Buchanan | 89/41.12 |
| 3,429,222 | 2/1969 | Whiston et al. | 89/41.02 |
| 3,572,163 | 3/1971 | Clark | 74/625 |
| 4,034,273 | 7/1977 | Meek et al. | 89/41.02 |

*Primary Examiner*—Stephen C. Bentley
*Attorney, Agent, or Firm*—Edward J. Biskup

[57] ABSTRACT

The invention disclosed herein relates to an armored vehicle having a rotatable cupola or turret for rotating a weapons system to the target. A system for driving the turret through an arc of rotation includes a ring gear fixed to the vehicle body and a pinion gear fixed for relative rotation to the turret for engaging the ring gear. The pinion gear is driven by a hydraulic motor to rotate the pinion and ultimately drive the turret. Integrated with the hydraulic motor and the ring gear is a manual disconnect apparatus which provides for manual operation in lieu of the motorized operation of the pinion gear. This manual apparatus includes a series of gears and an actuating assembly for moving at least one of the gears between an operative mode when a manual drive train is connected with the pinion gear and an inoperative mode when the manual drive train is disconnected from the pinion gear.

1 Claim, 3 Drawing Figures

AZIMUTH DRIVE ASSEMBLY

This is a continuation of co-pending application Ser. No. 437,852, filed on Oct. 29, 1982, now abandoned.

BACKGROUND AND DISCUSSION OF THE INVENTION

The invention generally relates to light armored vehicles having weapons systems located generally on the upper portion of the vehicle. A turret shell or a cupola supporting the weapons system rotates on bearings to enable movement of the weapons system throughout a 360 degree arc for firing on any target at any position relative to the light armored vehicle. Suspended from the turret is a turret basket which typically has two seats, one for a gunner and one for the commander to operate the weapons system as well as other elements within the vehicle. A drive system for rotating the turret and turret basket employs a motor, a pinion gear and ring gear assembly to drive the pinion and ultimately the turret through the desired arc.

Heretofore, azimuth drive systems, at least to a certain extent, have been characterized by their complexity, inefficiencies, inadequate provision for maintenance access, and manual backup. When a backup system has been provided, it has been unusually complex, often rendering it somewhat inefficient and not dependable.

The invention described herein overcomes many of the problems discussed above. The manual backup system in the invention described herein includes a disconnect apparatus for disconnecting the motor and connecting the manual portions of the apparatus for driving the pinion gear. This disconnect apparatus includes an exposed handle which is simply pressed by the operator from its normal position and rotated to lock the disconnect apparatus into an operative mode so that the pinion gear for driving the turret can be rotated manually. This system is spring biased to the inoperative mode such that, when the handle is unlocked, the system will automatically retract to the inoperative mode. By disengaging the manual apparatus in this manner unnecessary loading on the motor is largely eliminated, thus enhancing the efficiency of the motor when in operation. On the other hand, when the motor becomes inoperative for whatever reason, the manual apparatus can be connected quickly and efficiently by movement of the handle.

The hydraulic motor, which preferably is a ball piston type, employed is characterized by an internal relief mechanism such that it is not back loaded when the manual apparatus is in the operative mode. In other words, the motor will automatically revert to a "destroke" or no load operation thus avoiding the need for clutches or other mechanical connecting means.

Furthermore, the system described herein achieves minimum backlash, precision movement with economy and efficiency which is lacking in prior art systems. In addition to the type of hydraulic motor, and gear box chosen, which preferably is a circulate reducer, these features are achieved by spring biasing the pinion gear against the ring gear on the vehicle body. This permits the system to be self adjusting and accommodate eccentricities in the gearing system.

The above has been a general discussion of certain advantages of the invention described herein and deficiencies which have been noted in drive systems used heretofore with armored vehicles. Other advantages will be perceived in the detailed discussion of the preferred embodiment which follows.

DETAILED DESCRIPTION OF THE PREFERRED EMBODIMENT

Figure 1:
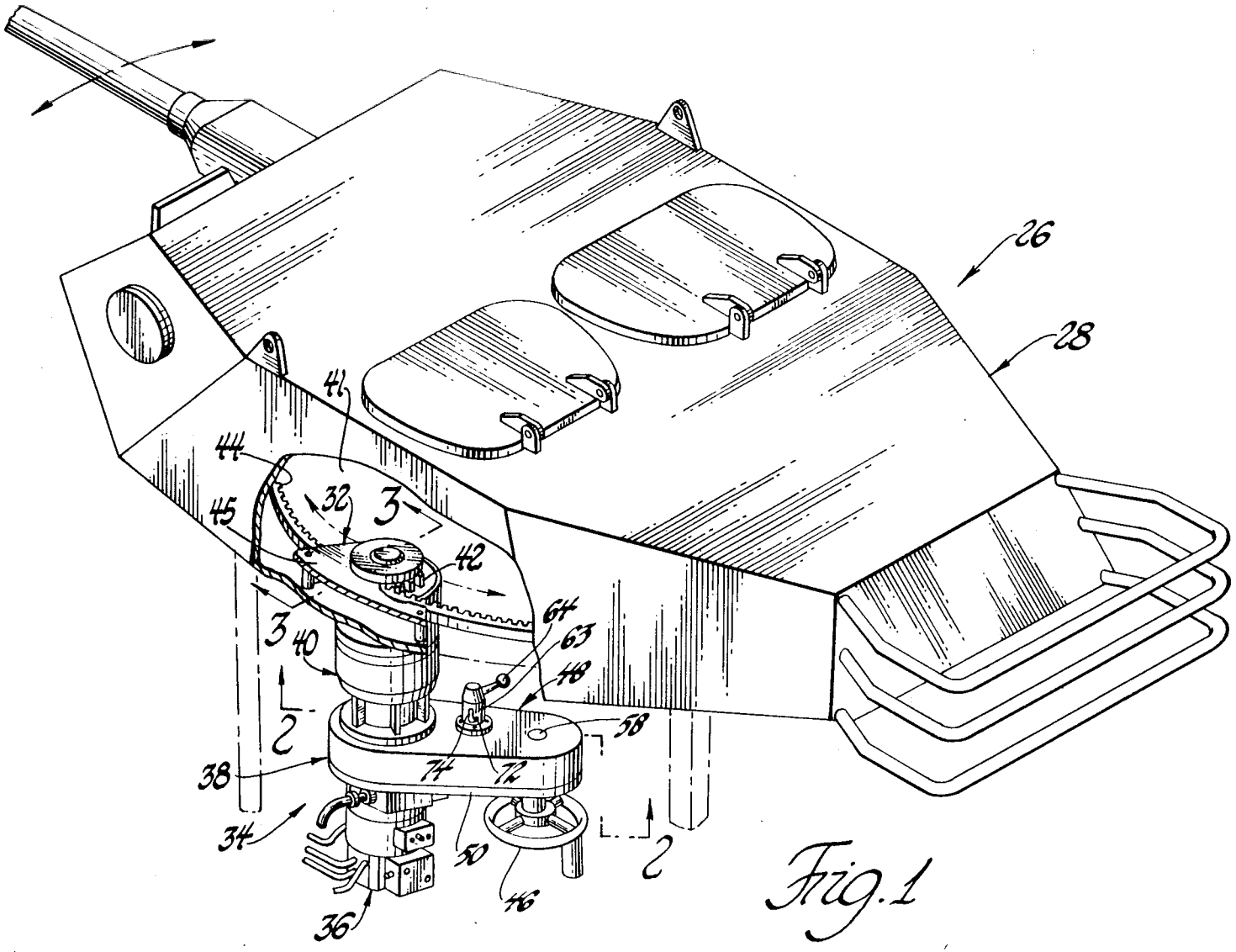
FIG. 1 is a perspective view of a turret assembly for a light armored vehicle with a portion broken away to show the interior of the vehicle in the vicinity of the turret.

Although the vehicle is not shown in detail, it can include any armored vehicle with a vehicle body supported on four, six or eight wheels or other moving means, including track. On the top portion of the vehicle body there is included a weapon system 26 as shown in FIG. 1 comprised of turret 28, or weapons system housing, which supports and carries a 25 mm weapon and a cage (not shown) which depends downwardly from the turret the interior portion of the vehicle body for carrying two operators, a gunner and a commander.

On the interior portion of the turret 28 there extends peripherally and radially toward the turret's center of rotation a support bracket 32 which releasably supports a drive assembly 34. For driving the turret and ultimately the weapons system through an arc, drive assembly 34 is controlled by an operator to direct the weapons system to the target being fired upon.

This drive assembly 34 includes a hydraulic motor 36 for driving through a gearbox assembly 38 and reduction gearbox 40, a drive pinion gear 42 to rotate the turret 28. Pinion gear 42 when so driven cooperates with ring gear 44 carried by the vehicle body to drive the turret 28 about the arc defined by the ring gear 44. Ring gear 44 is a circular ring having gear teeth on its inner periphery for engagement with the pinion gear 42. In this embodiment the center of the ring gear 44 generally coincides with the center of the vehicle, and the ring gear 44 is located adjacent the opening 41 for access to the turret. In some instances the center for the ring gear 44 may be offset from the vehicle center to accommodate other elements within the vehicle. The drive pinion gear 42 is secured to bracket 32 fixed to the turret 28 enabling the latter to be driven about the path defined by ring gear 42. Consequently, the center of rotation for the turret 28 is the same as that for ring gear 44.

Figure 3:
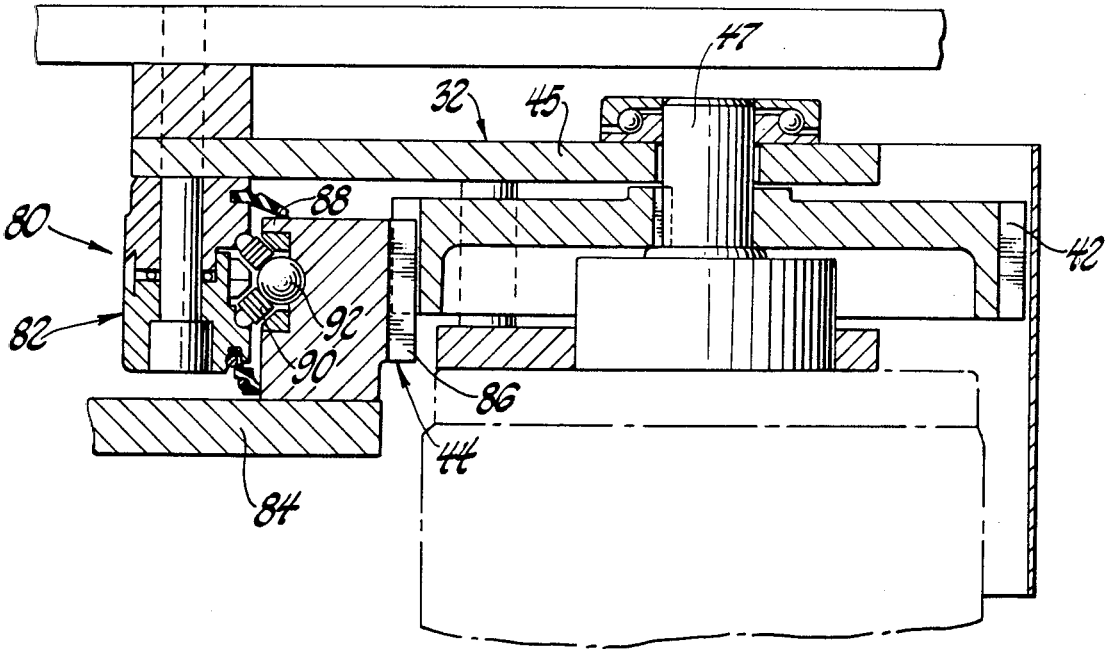
FIG. 3 is an enlarged cross-section of the pinion-gear assembly taken along lines 3—3 of FIG. 1.

A mechanism is provided to insure a proper relationship between pinion gear 42 and ring gear 44. As can be seen more clearly in FIG. 3 guide assembly 80 cooperates with elements of the ring gear 44 and its support structure as well as the pinion gear 42 and its support structure to maintain the correct relationship between operating parts. This mechanism includes a bearing member 82 fixed to the turret 28 for engaging the ring gear 44. The ring gear 44 on the other hand is fixed to ring gear bracket 84 which is in turn fixed to the vehicle body. The toothed side 86 of ring gear 44 is engaged by pinion gear 42 while rear side 88 is engaged by bearing member 82. Bearing member 82 carries a portion 90 of a bearing which cooperates with complementary portion 92 of the bearing fixed to rear side 88 of the ring gear 44 to define a bearing relationship between the turret 28 and the vehicle body.

The pinion gear 42 is carried in a movable bracket 45 which is fixed to the turret 28 at pivot shaft 47. Opposite the pivot shaft 47 bracket 45 is biased against ring gear 44 by spring 49. The spring can be chosen to provide any necessary bias, but in this embodiment it should provide between about 1000 to 2000 pounds per square inch (psi). Since bearing member 82 completely circumscribes the ring gear 44 and supports the pinion bracket 32, the desired dimensional relationship between the gears is always maintained as the turret is rotated. This results in smooth relative movement between the turret 28 and the vehicle body and proper engagement of the pinion 42 with the ring gear 44 for rotating the turret assembly. It minimizes backlash and enhances precision of operation as well.

Figure 2:
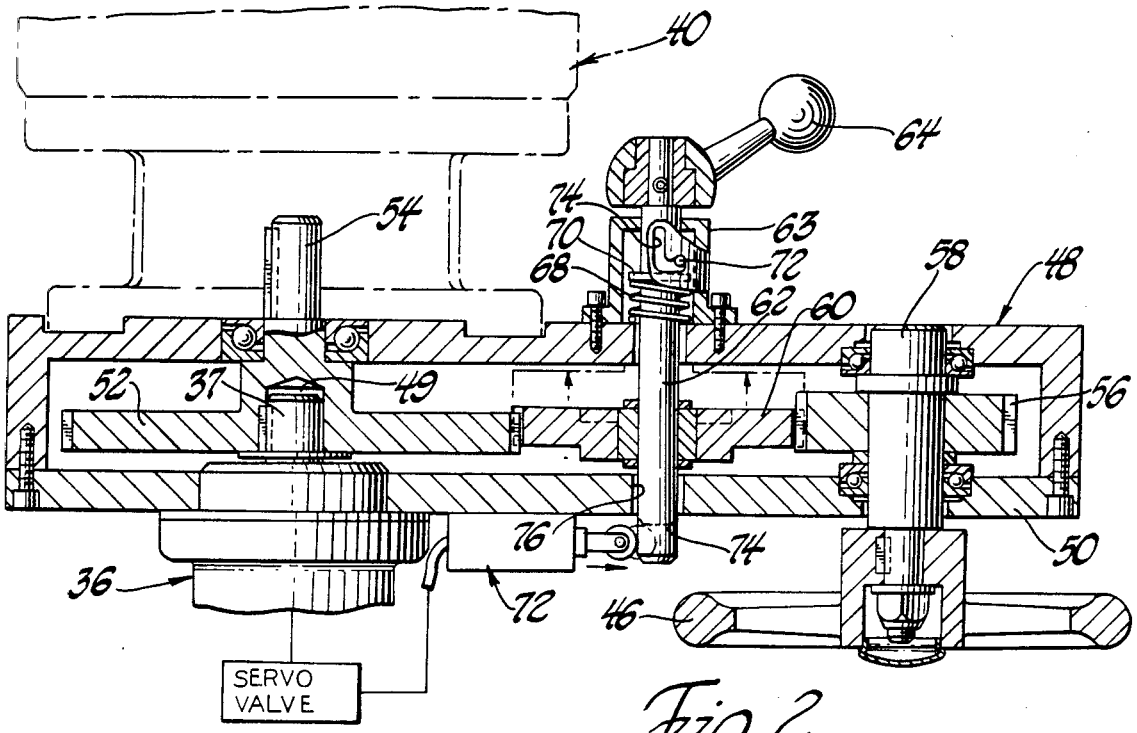
FIG. 2 is a cross-section of the disconnect apparatus taken along lines 2—2 of FIG. 1.

An electrical control system is employed for driving the hydraulic motor 36 to rotate the pinion gear 42 in one direction or another and ultimately move the weapons system 26 to the desired target. However, there may be occasions when the hydraulic system or the electrical system fails or for some other reason it becomes inconvenient or undesirable to use this system. A manual system 26 can be employed to move the weapons system to the desired position. This manual system as shown in FIG. 2 includes a handwheel 46 exposed for use by an operator and connected through a series of gears to rotate drive pinion gear 42 and drive the turret 28 about the ring gear 44.

This manual system includes a main gearbox housing 48 which has a removable main cover 50. Within gearbox housing 48 there is provided a main gear 52 mounted on main shaft 54, the latter extending beyond housing 48 for insertion into gearbox 40. This shaft 54 includes a key and cooperates with a cavity having a keyway in the gearbox 40. In this manner when mounted properly within the support bracket 32, the main shaft 54 of pinion gear 42 will extend within the reduction gearbox 40 to drivingly engage the gears therein and ultimately the pinion gear 42. Similarly, the hydraulic motor 36 defines a motor shaft 37 having a key thereon for driving engagement with shaft cavity 49 defined by the main gear 52 coaxially with the gearshaft 54.

Disposed laterally from the main gear 52 there is provided within the main gearbox housing 48 a manual drive-gear 56 which is mounted to drive-gear shaft 58 for rotation therewith. This gearshaft 58 extends beyond the housing cover, and there is secured thereto the handwheel 46 for rotating the shaft 58 and ultimately the manual gear 56.

Between these two gears, the main gear 52 and the manual gear 56, there is mounted an intermediate gear 60 for movement between an operative mode where the gear 60 engages both the main gear 52 and the manual gear 56 and an inoperative mode where it engages only one of these two gears. This intermediate gear 60 is mounted on intermediate gearshaft 62 on bearings so that such gear 60 rotates relative to the gearshaft 62. At one end of this gearshaft 62 there is fixed thereto a manual gear change handle 64 exposed for use by an operator from within the cage 30. Manual gear change housing 63 is secured to housing 48 for supporting elements used in moving intermediate gear 60. A portion of the intermediate gearshaft 62 extends beyond the housing 48 into gear change housing 63. Within the housing 63 there is provided a helical spring 68 which engages a spring retainer 70 fixed to shaft 62 for biasing the shaft 62 toward an inoperative mode. As can be seen from the phantom lines in FIG. 2 in the inoperative mode, intermediate gear 60 is positioned out of operative engagement with the main drive gear 52. As shown in solid lines gear 60 is in an operative mode where the gear 60 is engaged both with manual gear 56 and main drive gear 52.

A locking mechanism is provided to maintain intermediate gear 60, when moved to the operative mode, in engagement with both the manual gear 56 and the main drive gear 52. For this purpose, there is provided an L-shaped locking slot 74 which is engaged by a locking pin 72 extending from the periphery of shaft 62 as can be seen in FIG. 2. While pin 72 remains in the vertical portion of slot 74 vertical movement of intermediate gear 60 between the operative and inoperative modes is permitted. Once handle 64 is fully depressed and rotated to engage pin 72 with lateral portion of slot 74 vertical movement is blocked. This configuration enables the shaft 62 to be locked in an operative mode once it has been moved downwardly where intermediate gear 60 can engage both drive gear 52 and manual gear 56 as explained above. Although an L-shaped slot is shown, other configurations such as a spiral shape can also be used to accomplish the same purpose.

The system also includes a motor 36 which can be back-driven without hydraulically locking when the manual gear 56 is in the operative mode. Although not shown in detail, but shown in schematic in FIG. 2, the hydraulic motor 36 includes an electrically operated servo-valve for controlling the delivery of high pressure fluid to the motor. An automatic override is integrated with hydraulic motor 36 to close the servo-valve when the manual disconnect mechanism is actuated to the operative mode. The purpose of such a system is to allow manual operation of main gear 52 without the hydraulic system being inadvertantly actuated by the electrical system.

This disconnect system includes a switch 72 located beneath housing 48 for actuation by shaft 62. Shaft 62 includes a lower portion 74 arranged for extension and retraction with respect to housing 48 in passage 76. This lower portion is at an end of shaft 62 opposite that portion secured to handle 64. When handle 64 is moved to the operative mode, lower portion 74 is extended to trip switch 72 causing the electrical servo-valve to close. The switch is spring loaded so that when handle 64 is moved to the inoperative mode, lower portion 74 is retracted into the housing 48 thereby permitting switch 72 to automatically revert to an open position. This permits the electrically operable servo-valve to open thus connecting the hydraulic power source to the system.

The hydraulic motor 36 itself is one which has special features when employed with the manual system in the operative mode. The motor 36 employed is a *Planet Hydraulic Motor* manufactured by The Planet Products Corporation. A feature of this hydraulic motor is that once the disconnect mechanism is placed in a manual mode, the motor will automatically revert to a no load operation where it is "destroked" and goes to "center". This reduces substantially any load which might otherwise be placed on the manual system by hydraulic fluid in the motor. As a result, the operator can turn the wheel 46 to manually rotate the turret 28 with minimal resistance by hydraulic fluid in the motor 36.

During operation in the normal mode, hydraulic motor 36 engages main drive gear 52 and rotates it at a predetermined speed. The main drive gear 52 through shaft 54 engages the reduction gearbox assembly 40 manufactured by Graham Company of Menomonee Falls, Wisc. and drives the pinion gear 42. In this normal mode the intermediate gear is in the inoperative mode disconnected from the main drive gear 52, and handle 64 is in an extended vertical position. Should the hydraulic motor 36 become disconnected or inoperative for whatever reason, the manual drive assembly can be connected by operation of the manual gear change handle 64. Handle 64 is simply pushed downwardly to move shaft 54 correspondingly in a downward motion where the intermediate gear is engaged with the main drive gear 52 as well as the manual gear 56. Once the downward motion is completed as far as it can go handle 64 is rotated such that pin 72 is moved into the lateral portion of the locking slot 74. Handle 64 is simply released in this position, and the bias force imparted by helical spring 68 maintains the pin in this lateral portion of the locking slot 74 thereby locking the shaft 62 in the inoperative mode. Since the gear 60 is engaged with both the manual gear 56 and the main drive gear 52, handle 64 now is operatively connected through this gear train ultimately to the pinion gear 42. Consequently, in orienting and moving the turret 28 to target, the manual or hand wheel 46 is rotated in the direction as desired. This movement of hand wheel 46 creates a corresponding movement of pinion gear 42 on the ring gear 44 as described above. When it is desired to disconnect the manual handwheel 46 from manual mode, handle 64 is simply rotated until the pin 72 reaches the vertical portion of the locking slot 74 at which point the handle 64 is simply released and the bias of helical spring 68 will force the shaft 62 and the intermediate gear 60 to the inoperative position or mode out of contact with main gear 52.

The above has been only a detailed discussion of the preferred embodiment of the invention. The full scope of the invention are set out in the claims which follow.

What I claim is:

1. An armored vehicle having a weapons system comprising:

a vehicle body; a weapons system housing mounted on said vehicle body for relative rotation therewith; said weapons system housing having a ring gear and said vehicle body having a pinion gear for engagement with said ring gear; hydraulic motor means for rotating said pinion gear while in engagement with said ring gear to drive said weapons system housing rotatably along a path defined by the ring gear; manual drive means including a manual drive gear connected to a hand operated wheel exposed for use by an operator, a main drive gear drivingly connected between said hydraulic motor means and said pinion gear, and an intermediate gear arranged for engagement with the manual drive gear and the main drive gear to transmit rotative movement of the manual drive gear to the main drive gear, disconnect means for moving the intermediate gear between an operative mode where rotative movement of the manual drive gear is transmitted by the intermediate gear to the main drive gear and an inoperative mode where the intermediate gear is disengaged from one of said manual drive gear and said main drive gear, said disconnect means including an intermediate gear shaft to which the intermediate gear is mounted, said intermediate gearshaft being arranged for movement between said operative and inoperative modes, bias means engaging said gear shaft and biasing said gear shaft toward the inoperative mode, locking means for locking said gear shaft in the operative mode, a manual gearshaft supporting said manual drive drive gear for rotation about an axis substantially parallel to the axis of rotation of said main drive gear, said hand operated wheel secured to an exposed portion of said manual gearshaft for rotating said manual drive gear and thereby providing rotation of said main drive gear when said disconnect means places said intermediate gear in said operative mode, and means cooperating with said intermediate gear shaft for placing said hydraulic motor means in a no-load condition when said disconnect means is in said operative mode so as to allow without backload manual rotation of said hand operated wheel and said manual drive gear which through said intermediate gear provides drive to said main drive gear for driving said pinion gear when said hydraulic motor means is disabled.

* * * * *